US007328515B2

(12) United States Patent
Helm et al.

(10) Patent No.: US 7,328,515 B2
(45) Date of Patent: Feb. 12, 2008

(54) ARCHERY BOW SIGHTS AND ARCHERY BOWS INCLUDING SAME

(75) Inventors: Timothy L. Helm, Conroe, TX (US); Robert L. Thompson, Montgomery, TX (US)

(73) Assignee: H-T Archery Products LLC, Conroe, TX (US)

( * ) Notice: Subject to any disclaimer, the term of this patent is extended or adjusted under 35 U.S.C. 154(b) by 0 days.

(21) Appl. No.: 11/388,544

(22) Filed: Mar. 24, 2006

(65) Prior Publication Data

US 2007/0220761 A1 Sep. 27, 2007

(51) Int. Cl.
*F41G 1/467* (2006.01)

(52) U.S. Cl. ..... 33/265; 124/87

(58) Field of Classification Search ..... 33/265; 124/87, 88

See application file for complete search history.

(56) References Cited

U.S. PATENT DOCUMENTS

| | | | | |
|---|---|---|---|---|
| 2,654,152 A | | 10/1953 | La Vire | |
| 2,925,656 A | * | 2/1960 | Genovese | 33/265 |
| 3,310,875 A | | 3/1967 | Kowalski | |
| 3,579,839 A | | 5/1971 | Kowalski | |
| 3,787,984 A | * | 1/1974 | Bear et al. | 33/265 |
| 3,822,479 A | | 7/1974 | Kowalski | |
| 4,020,560 A | | 5/1977 | Heck | |
| 4,162,579 A | | 7/1979 | James | |
| 4,543,728 A | | 10/1985 | Kowalski | |
| 4,726,123 A | | 2/1988 | Keller | |
| 4,823,474 A | | 4/1989 | Reynolds | |
| 4,846,141 A | | 7/1989 | Johnson | |
| 4,884,347 A | | 12/1989 | Larson | |
| 4,910,874 A | | 3/1990 | Busch | |
| 5,050,576 A | | 9/1991 | Larson | |
| 5,072,716 A | | 12/1991 | Sappington | |
| 5,122,932 A | | 6/1992 | Ziller | |
| 5,509,401 A | | 4/1996 | Trubic | |
| 5,802,726 A | | 9/1998 | Trosper, Jr. et al. | |
| 5,836,294 A | | 11/1998 | Merritt | |
| RE36,266 E | | 8/1999 | Gibbs | |
| 5,941,226 A | | 8/1999 | Marietta | |

(Continued)

OTHER PUBLICATIONS

Archery History.com, accessed Mar. 2, 2006, http://www.archeryhistory.com/index.php.

(Continued)

*Primary Examiner*—G. Bradley Bennett
(74) *Attorney, Agent, or Firm*—Pramudji Wendt & Tran, LLP; Jeffrey L. Wendt

(57) ABSTRACT

Archery bow sights, and archery bows including same are described, the bow sight comprising a sight pin guard having a portion defining a sighting plane, a rotatable shaft having ends installed in the sight pin guard, and at least one sight pin having a connector end and a sight end, the connector end removably and adjustably installed on the rotatable shaft. Certain embodiments comprise a plurality of sight pins arranged on the rotatable shaft at different longitudinal and circumferential locations so that upon rotation of the shaft a different one of the sight pins is viewable in the plane defined by the sight pin guard. This abstract allows a searcher or other reader to quickly ascertain the subject matter of the disclosure. It may not be used to interpret or limit the scope or meaning of the claims. 37 CFR 1.72(b).

7 Claims, 10 Drawing Sheets

U.S. PATENT DOCUMENTS

| | | | | |
|---|---|---|---|---|
| 6,401,347 | B1 | 6/2002 | Slates | |
| 6,418,633 | B1 | 7/2002 | Rager | |
| 6,430,822 | B1 | 8/2002 | Slates | |
| 6,477,780 | B2 | 11/2002 | Aldred | |
| 6,494,604 | B2 | 12/2002 | Khoshnood | |
| 6,508,005 | B2 | 1/2003 | Springer | |
| 6,539,637 | B1 | 4/2003 | Hollabaugh | |
| 6,560,884 | B1 | 5/2003 | Afshari | |
| 6,564,462 | B1 | 5/2003 | Henry | |
| 6,601,308 | B2 | 8/2003 | Khoshnood | |
| 6,609,306 | B2 | 8/2003 | Johnson et al. | |
| 6,634,110 | B2 | 10/2003 | Johnson | |
| 6,651,350 | B1 * | 11/2003 | Manns et al. | 33/265 |
| 6,688,008 | B1 | 2/2004 | Wuthrich | |
| D487,789 | S | 3/2004 | Rager | |
| D489,427 | S | 5/2004 | Rager | |
| 6,745,482 | B1 | 6/2004 | Mallozzi | |
| 6,823,597 | B2 | 11/2004 | Larson | |
| 6,842,989 | B1 | 1/2005 | Wuthrich | |
| 6,862,813 | B1 | 3/2005 | Chen et al. | |
| 6,892,462 | B2 | 5/2005 | Rager | |
| 6,938,349 | B2 | 9/2005 | Afshari | |
| 7,036,234 | B2 | 5/2006 | Rager | |
| 7,124,512 | B2 * | 10/2006 | Forrest | 33/265 |
| 2003/0177651 | A1 * | 9/2003 | Stone | 33/265 |
| 2006/0080848 | A1 * | 4/2006 | Lace | 33/265 |

OTHER PUBLICATIONS

Archery History.com, accessed Mar. 2, 2006, http://www.archeryhistory.com/sights/sightsmain.htm.

Bowhunt America, Apr. 2006, COBRA Bowhunting Products advertisement for bow sights, p. 25.

Bowhunting, Fall 2004 Catalog, pp. 64-73, Keystone Country Store, Fort Loudon, PA.

* cited by examiner

ARCHERY BOW SIGHTS AND ARCHERY BOWS INCLUDING SAME

BACKGROUND OF THE INVENTION

1. Field of Invention

The present invention generally relates to archery. More particularly, the present invention relates to archery bow sighting devices, commonly referred to as bow sights, and archery bows including these sights.

2. Related Art

Bow sights have been around, in various forms, for many years. An interesting web site devoted to archery is Archery-History.com, which shows a history of bow sights and other archery accessories. Basically, a bow sight may be described as a device that an archer uses to aim a bow and arrow at a target, which may be a live target or a practice target. Typically, a bow sight consists of a platform that is connected to the side of the bow, and its purpose is to support one or more sight-pins. These sight-pins are what the archer actually aligns with the target to aim his bow. A representative example is illustrated in FIG. 1, illustrating how an archer might view a target, in this case a deer 2 illustrated in phantom, through a conventional bow sight 4 having six sight pins 6. Sight pins, as the name implies, are simply pins or studs. At the ends of pins 6 are points 8, which may be dots or cross hairs. The archer uses the sight pins to "sight-in" his bow. He does this by placing these objects in direct alignment between his eye and the desired target. The sight pins are not easily removed from the line of vision, and are fixed in the positions shown, either by attachment to a bracket 10 that is part of the bow, or to a sight pin guard 12. It is also common to have one or more level gauges 14, 16.

Most archers use more than one sight pin on their bow sight. This multiple pin configuration is necessary, due to the arcing trajectory of the flight of an arrow. For example, if the archer were to "sight-in" his bow with one pin set to be on target at a distance of 20 yards, he would need another pin to be set for a 30 yard target, and another one for 40 yards, and so on. As a result, the majority of the bow sights that are used by archers today (such as illustrated in FIG. 1) carry multiple sight pins that lie in the same plane between the archer's eye and the target. However, it is this very arrangement that creates an aiming problem, in that, the very pins that are used to aim at the target, also restrict the archer's view of the target. The level sight gauges may also partially interfere with the view of the target. While there are other bow sights on the market using one sight pin, they do not allow the archer the flexibility to easily and quickly change between sight pins for different distances.

Other inventors have attempted to solve this problem, but with limited success. It would be a positive advance in archery if the archer's view of the desired target might be increased during shooting without losing the ability to sight-in the bow for different target ranges. It would also be an advance in archery if a bow sight could be designed to allow the archer to change between sight pins easily and quickly.

SUMMARY OF THE INVENTION

In accordance with the present invention, archery bow sights and archery bows including same are described that are a complete break in design with previously known bow sights and reduce or overcome problems in previously known apparatus. This is accomplished by placing multiple sight pins on a rotatable shaft. In the reference frame of a bow, the rotatable shaft is installed vertical. Individual pins are accessible to the archer by twisting or rotating the shaft, or a knob attached to the shaft, until the desired sight pin comes into view. This design may allow the archer to independently adjust each sight pin for a given distance to the target, and to view only that one sight pin within the same sighting plane as the target itself. The result is that the archer has an unrestricted view of both the target and the sight pin that has been selected for a particular distance.

Thus, a first aspect of the invention is an apparatus comprising:

a) a rotatable shaft adapted to be installed in a bow or in a sight pin guard; and b) at least one sight pin having a connector end and a sight end, the connector end removably and adjustably installed on the rotatable shaft.

A second aspect of the invention is an apparatus comprising:

a) a sight pin guard defining a sighting plane;

b) a rotatable shaft having ends installed in the sight pin guard; and c) a plurality of sight pins, each sight pin having a connector end and a sight end, the connector ends removably and adjustably installed at different longitudinal and circumferential locations on the rotatable shaft so that upon rotation of the shaft a different one of the sight pins is viewable in the sighting plane.

A third aspect of the invention is an archery bow comprising either the first or the second aspect of the invention.

As used herein the term "sight pin guard" means a shaped piece of metal, plastic, or composite material that generally defines a circular, rectangular, or other shaped open area in a plane adapted to be between a shooter's eye and a target when shooting at the target and in which may be positioned a sight pin. In certain embodiments, the rotatable shaft is indexed or "indexable", meaning that rotation of the shaft from a first position that allows viewing a first sight pin, to a second position that allows viewing of a different sight pin, is accompanied by a temporary locking of the shaft in the two positions. In other words, "indexing the shaft" means rotating the shaft from one temporarily fixed position where one sight pin is viewable in the plane of the sight pin guard, to another fixed position where another sight pin is viewable in the plane of the sight pin guard.

These and other features of the apparatus and methods of the invention may become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it may be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

Figure 1:
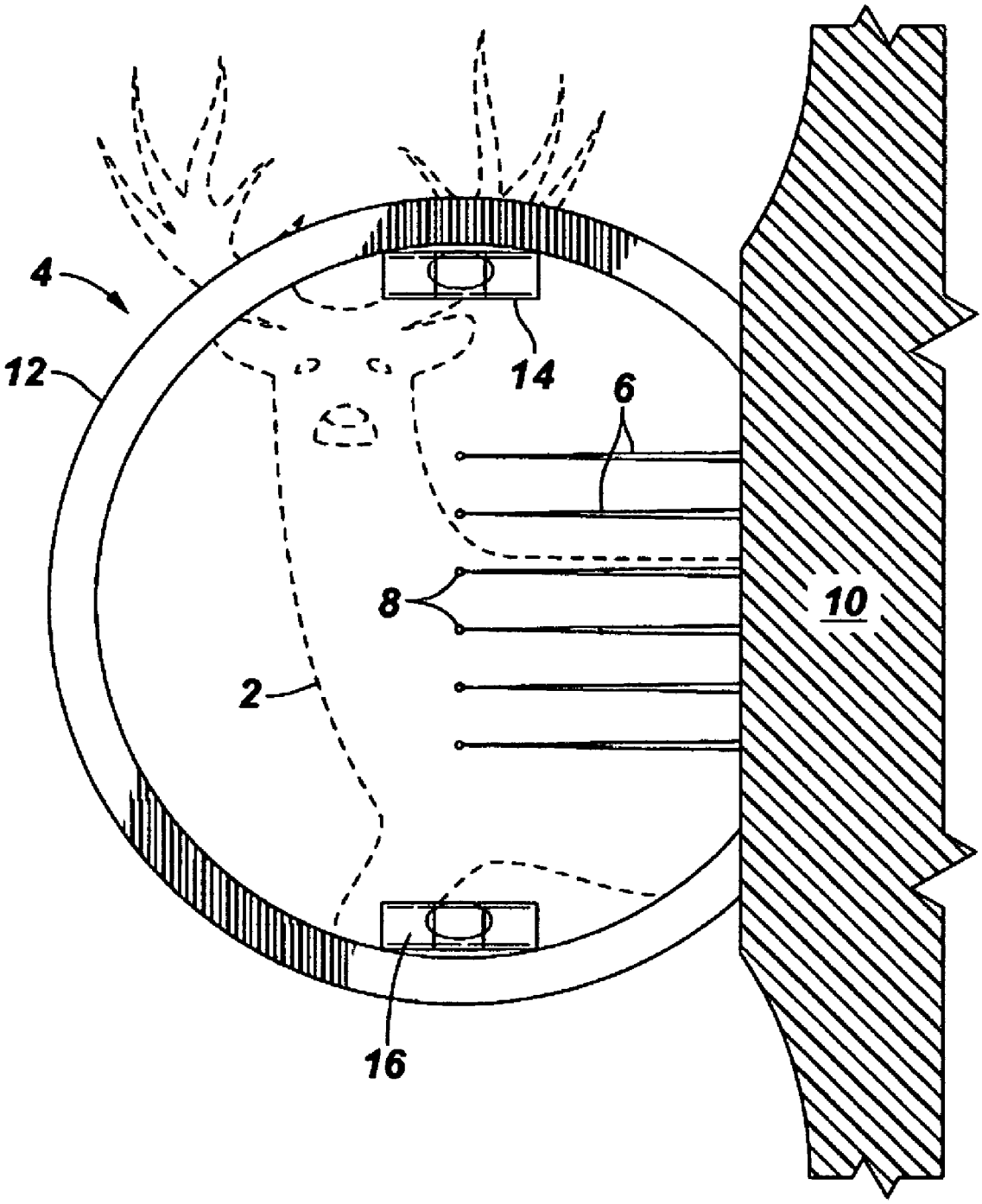
FIG. 1 (Prior Art)
FIG. 1 is a schematic, partial cross section view, with a phantom figure illustrating a prior art bow sight with six stationary sight pins.

As noted previously, most archers use more than one sight pin on their bow sight. This multiple pin configuration is necessary, due to the arcing trajectory of the flight of an arrow. For example, if the archer were to "sight-in" his bow with one pin set to be on target at a distance of 20 yards, he would need another pin to be set for a 30 yard target, and another one for 40 yards, and so on. As a result, the majority of the bow sights that are used by archers today (such as illustrated in FIG. 1) carry multiple sight pins that lie in the same plane between the archer's eye and the target. However, it is this very arrangement that creates an aiming problem, in that, the very pins that are used to aim at the target, also restrict the archer's view of the target. The level sight gauges may also partially interfere with the view of the target.

Apparatus of the invention address this obscured vision problem. Apparatus of the invention comprise a rotatable shaft, somewhat akin to a "pin wheel", installed on a bow already having sight pin guard, or installed as part of a sight pin guard and platform assembly which is then attached to a bow. The shaft may be metal, plastic, or composite material. The rotatable shaft has at least one, and in certain embodiments a plurality of sight pins removably attached thereto, each sight pin having a connector or anchor end and a sight end. The connector or anchor ends are removably and adjustably installed at different longitudinal and circumferential locations on the rotatable shaft. As used herein "shaft" includes single and multiple pieces, such as a sleeve over a central core shaft.

Attaching the sight pins to the rotatable shaft may proceed through many variations. Sight pin anchors may ride in longitudinal slots that are machined, cut, or molded into the shaft, or in a sleeve that slips over a core shaft. In these embodiments, the slots may or may not extend along the shaft's entire length. The slots may be machined, cut, or molded directly through the central axis of the shaft or along its outside edge. At least one slot is present, although there may be as many slots as the desired number of sight pins. In embodiments wherein there are two sight pins, the slots may be spaced circumferentially 180 degrees apart; in other embodiments having two sight pins, one slot may be used for two sight pins, with one sight pin near one end of the slot, the other sight pin near the bottom of the slot. When the archer desires three sight pins, the slots may be 120 degrees apart. When the archer desires four sight pins, the slots may be 90 degrees apart. The slots and mating sight pin anchors may be in any form or shape allowing the sight pins to move up and down the shaft.

Sight pins useful in the invention may be made to actually ride inside the slots on the rotatable shaft or may ride on small parts that have been machined to fit inside mating slots that are machined into the shaft. For example, a dovetail slot may be cut into the rotatable shaft and a mating piece of dovetail material (metal, plastic, or composite) may be machined, molded, or otherwise made to fit in this slot. The sight pin may have the mating piece as an integral part of the sight pin; the mating piece is sometimes referred to herein as a sight pin anchor. Placing setscrews in the dovetail material allows adjustments to be made to each sight pin's vertical position. When these setscrews are tightened against the rotatable shaft, the sight pin anchor, and therefore the sight pin, remains locked in position and when they are loosened, the pin assembly may be moved to the desired location.

Alternatively, instead of dovetail slots, one or more rectangular slots may be machined or cut into the rotatable shaft that accommodates a mating piece of flat material. The sight pin would then be attached to a correspondingly sized piece of flat stock, and again the vertical adjustment would be made by tightening or loosening setscrews in the flat material and moving the pin up or down on the rotatable shaft. Those skilled in the art will no doubt be able to envision other shaped slots and sight pin anchors, and these variations are considered within the scope of the invention.

An alternative to slots for attaching the sight pins is to have a rotatable shaft with one or more sight pins removably attached to the shaft with rubber O-rings. The sight pins may be made (for example molded) to have the O-rings as an anchor. The O-rings are simply slipped onto the shaft and held on the shaft by friction.

Apparatus of the invention allow the archer to independently adjust each sight pin for a given distance to the target, and to view one sight pin within the same sighting plane as the target itself. In some embodiments the archer may choose to have two sight pins viewable, for example a top and a bottom sight pin. If the sight pins could be made thin enough, multiple sight pins could be viewed in the plane of the sight guard, as in the prior art, except that apparatus in accordance with the invention allow rotating the sight pins into and out of the archer's view, if desired, just by rotating the shaft. In any case, the result is that the archer may have a substantially unrestricted view of both the target and the sight pin or pins that have been selected for a particular distance.

Individual sight pins are accessible to the archer by twisting the rotatable shaft or a knob on the shaft until the desired sight pin or pins comes into view. The rotatable shaft may be indexed to stop at each sight pin location by means for indexing, such as spring-plungers, spring and ball bearing devices, and the like, placed in the knob at the top or bottom of the rotatable shaft, or both top and bottom if desired. The plungers or ball bearings come to rest in holes drilled into the sight pin guard (or bow frame) at appropriate locations. The sight pin guard is that part of the bow sight apparatus that protects the sight pins from possible damage. In certain embodiments of the invention the sight pin guard also supports the rotatable shaft. Alternatively, the spring-plungers or other devices could be installed in the sight guard (or bow frame), with the indexing holes in the holes drilled in the knob at the top or bottom of the rotatable shaft.

Apparatus of the invention having multiple sight pins on a rotatable shaft, which then may be rotated about its longitudinal axis until the desired pin or pins come into view, is a primary feature of the invention. In effect, we have created a bow-sight that greatly simplifies an archer's sighting picture to a specific target that lies at a specific distance.

Apparatus of the invention may have other advantages as well. For instance, each sight pin may be marked for its "sighted-in" range, and this may eliminate confusion for the archer as to which sight pin is in use. In certain apparatus embodiments of the invention, means for marking, such as decals, engravings or other means for marking may be placed on the shaft to mark each sight pin's range setting. Another advantage of the archer seeing only one or two sight pins at a time becomes apparent when a peep sight is used. A peep sight is the archer's rear sight. It is located on the bowstring. The archer looks through a usually round aperture to view both the sight pins and the target. With a conventional, multiple pin bow sight, the archer views many pins in a loose configuration within the opening of the peep sight, resulting in a certain degree of inaccuracy for the archer. Apparatus of the present invention, however, allow the archer to see only as many sight pins as are necessary, for example one or two sight pins at a time, and this sight pin may be aligned directly in the center of the peep sight. This makes for a much more precise sighting system for the archer.

In most embodiments of the invention the archer will choose to use only one sight pin in a sight plane. However, in certain embodiments of the invention, as explained earlier, the manufacturer or the archer might wish to place two sight pins in the sight plane. For instance, the sight may have pins set for 20-40, 30-50, 40-60 and 50-70 yards, thus giving the archer a bow that's "sighted-in" from 20 yards out to 70 yards, in 10 yard increments. The 20-40 yard setting would have two pins in the same sight plane (in the same slot if slots are used to attach the sight pins), and so on. These embodiments conform to the idea of having multiple sight pins arranged on a rotatable shaft in such a manner that not all the sight pins are visible to the archer at each indexed location of the shaft.

Figure 2:
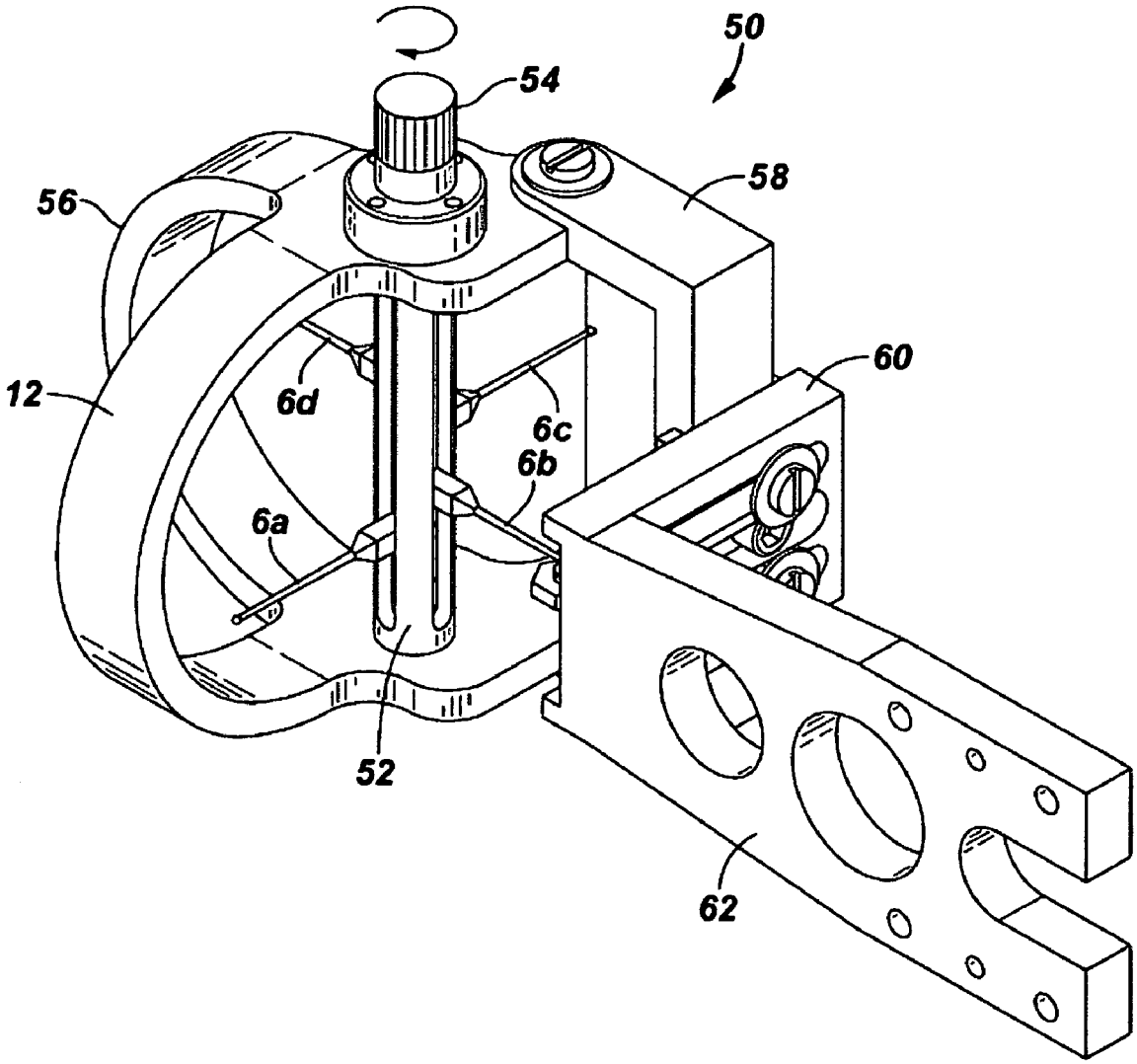
FIG. 2 is a schematic perspective view of one bow sight embodiment according to the teachings of the present invention.

Referring now to the drawing figures, wherein identical reference numerals are used throughout the several views for like or similar elements, FIG. 2 is a schematic perspective view of one bow sight embodiment 50 according to the teachings of the present invention. It should be noted that the drawing figures illustrate a bow sight and bow for a right-handed archer, and that bow sights and bows suitable for use by left-handed archers are also considered within the invention, and would merely require reversing or mirror imaging the features of the right-handed bow sight and bow illustrated in the figures. Embodiment 50 includes a rotatable shaft 52 that is rotatable by turning a knob 54 in the direction of the arrow above knob 54. Shaft 52 and knob 54 may rotate in the other direction as well when desired. Rotatable shaft 52 is illustrated as being substantially vertical, but the invention is not so limited. Bow sight 50 includes a pin sight guard that is in two portions, side portion 12 and forward portion 56, having an angle of 90 degrees between them. This angle is somewhat arbitrary; a 90 degree angle affords protection to two sight pins that are 90 degrees apart, as maybe the case in embodiment 50, having four sight pins 6*a*, 6*b*, 6*c*, and 6*d* removably and slidably attached to rotatable shaft 52. Bow sight 50 includes a vertical adjustment block 58 and an attachment block 60 for a horizontal adjustment block (not shown in this view), as well as a bow sight platform 62. Attachment block 60 and platform 62 may be fabricated as one unit. More detailed descriptions of the individual components of embodiment 50 are provided in the ensuing description. It may be seen that rotating of rotatable shaft 52 from the position illustrated will cause sight pin 6*b* to be indexed into the position presently occupied by sight pin 6*a*.

Figure 3:
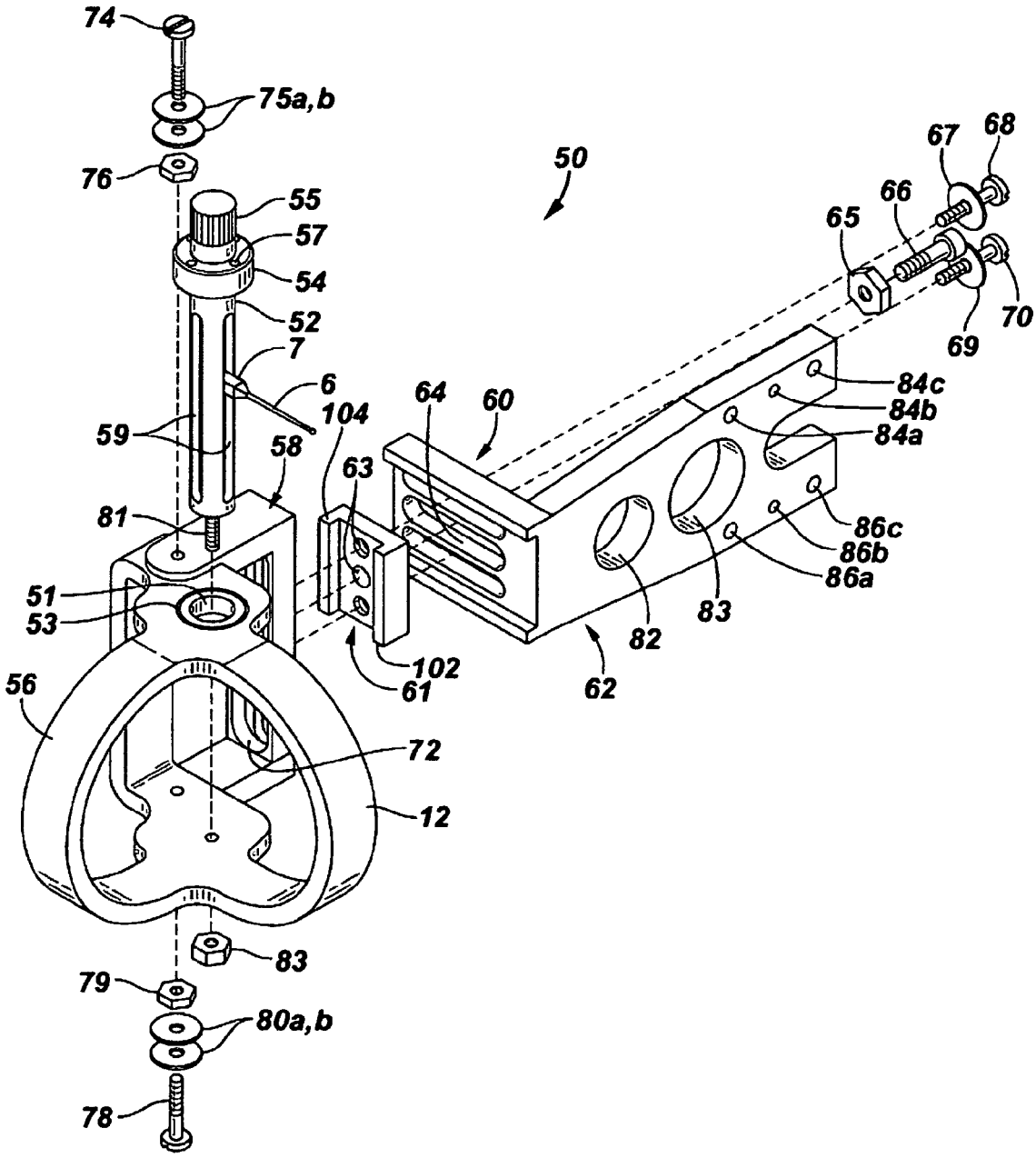
FIG. 3 is an exploded perspective view of the bow sight of FIG. 2.

FIG. 3 is an exploded perspective view of bow sight 50 of FIG. 2, illustrating more details of construction of this embodiment. Horizontal adjustment block 61 is viewable, having three adjustment holes 63 (illustrated in more detail in FIG. 6) that mate with corresponding lateral slots 64 in attachment 60, along with a nut 65 and cap screw 66. As illustrated in FIG. 6, the two outside holes 63 are threaded, while the middle hole 63 is not in this embodiment. Screw 66 fits inside middle hole 63 in block 61. Nut 65 may slide within a slot 72 in vertical adjustment block 58, allowing block 58 to slide up and down in rails 102 and 104 of block 61, thus allowing vertical adjustment of the bow sight. Screws 68, 70 and washers 67, 69 allow movement of block 60 in a horizontal direction when loosened, providing horizontal adjustment for the bow sight. In embodiment 50, four slots 59 are provided for receiving four sight pin anchors 7. Only two slots are viewable in FIG. 2, and only one sight pin 6 is shown for clarity. Rotatable shaft 52 is inserted through and is held by a through hole 51. Rotatable shaft 52 also includes means for indexing 57, which may be spring-plunger or other type of indexing means. In a spring-plunger arrangement, a plunger slides in a groove 53 until a mating hole or detent is met, upon which the plunger extends and sets the position of rotating shaft 52, and one of the sight pins 6. Vertical adjustment block 58 attaches to sight pin guard 12 at the bottom of the apparatus using a screw 78, a pair of washers 80*a,b*, and a screw 79, and at the top using another screw 74, another pair of washers 75*a,b*, and another nut 76. Knob 54 on rotatable shaft 52 may have a knurled surface 55 as illustrated. Bow sight platform 62 may have one or more holes 82 and 83 for weight reduction. Holes 84*a* and 86*a* allow attachment of the bow sight to a bow in one position, while holes 84*c* and 86*c* allow attachment of the bow sight to a bow in another position. Holes 84*b* and 86*b* may be used for attachment of a bow quiver. Any or all of these holes may accept flat head screws or other type screws, or other attachment means.

Figure 4A:
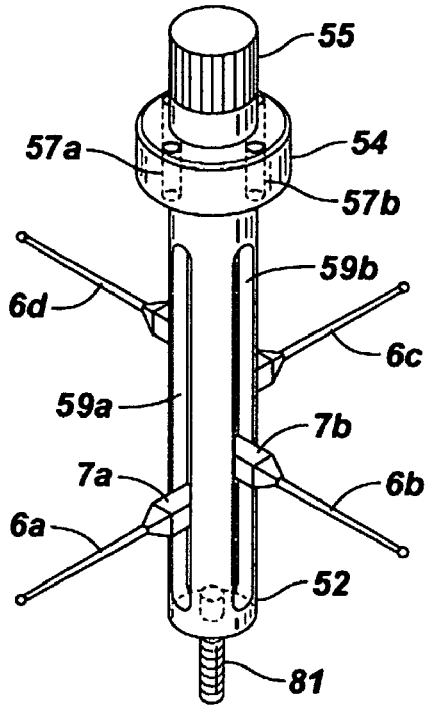
FIGS. 4A, 4B, and 4C are schematic perspective (with some parts in phantom), a side elevation, and top plan views, respectively, of the rotatable shaft illustrated in the bow sight of FIG. 2.
Figure 4B:
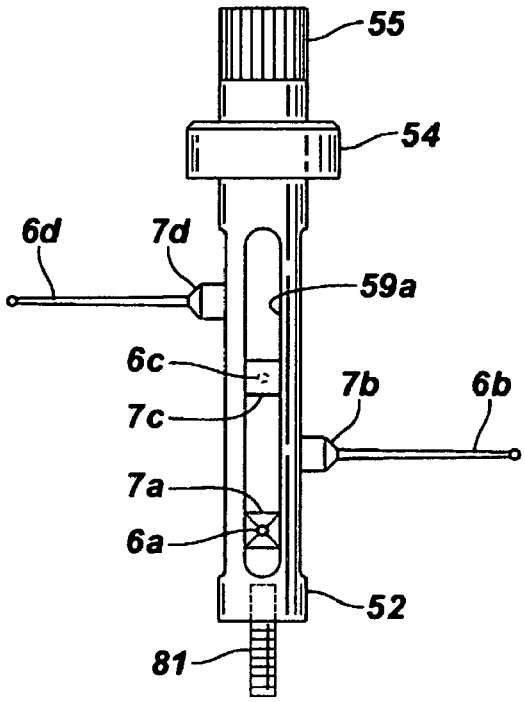
Figure 4C:
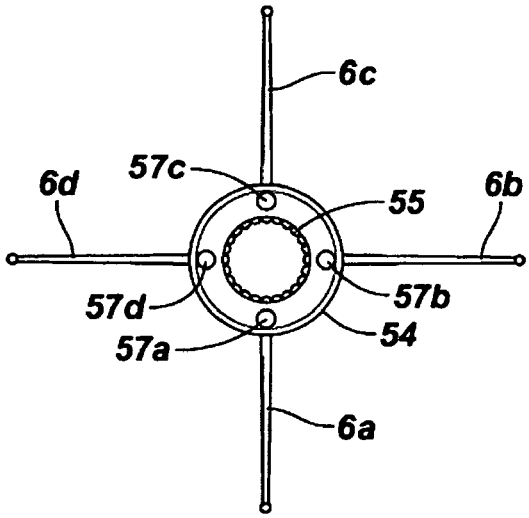

FIGS. 4A, 4B, and 4C are schematic perspective (with some parts in phantom), a side elevation, and top plan views, respectively, of the rotatable shaft illustrated in the bow sight of FIG. 2. Views 4A and 4B clearly illustrate four sight pins 6*a*, 6*b*, 6*c*, and 6*d*, having respective anchors 7*a*, 7*b*, 7*c*, and 7*d* positioned removably and slidably within slots (only two slots 59*a*, 59*b* shown) in rotatable shaft 52. Anchors 7 may comprise a deformable material, such as an elastomer or other polymeric material, able to deform and fit into slots 59. Alternatively slot 59 may have wide areas where a relatively rigid anchor 7 could be inserted, and slid into a more narrow position in a slot, wedging into the slot. FIG. 4*c* illustrates two locations for means for indexing, 57*a*, and 57*b*. Illustrated also is a threaded stud 81 which mates with a locknut (not shown) used to fasten rotatable shaft 52 to sight pin guard 12.

Figure 5A:
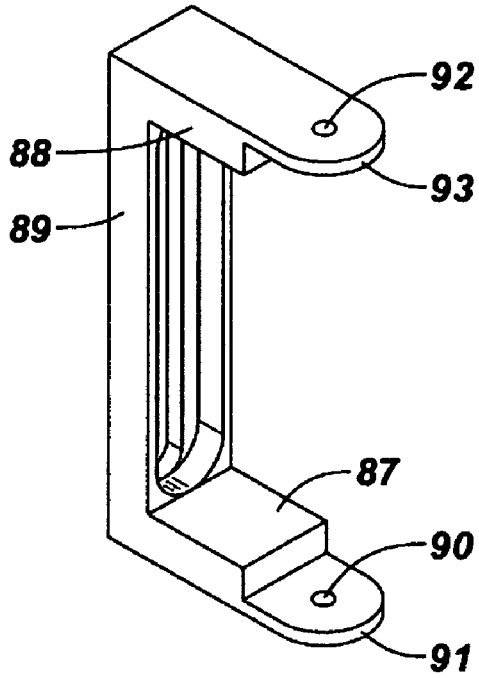
FIGS. 5A, 5B, and 5C are schematic perspective, front elevation, and cross sectional views, respectively, of the vertical adjustment block illustrated in the bow sight embodiment of FIG. 2.
Figure 5B:
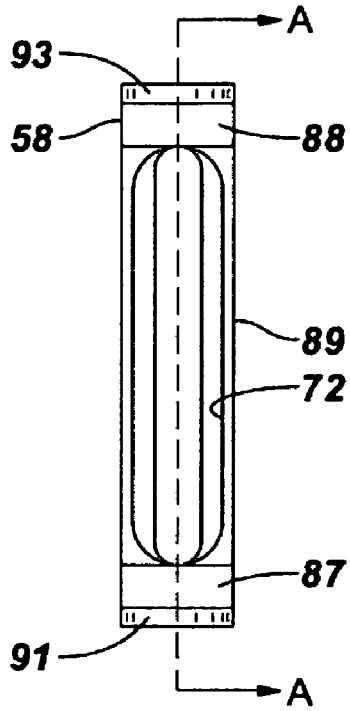
Figure 5C:
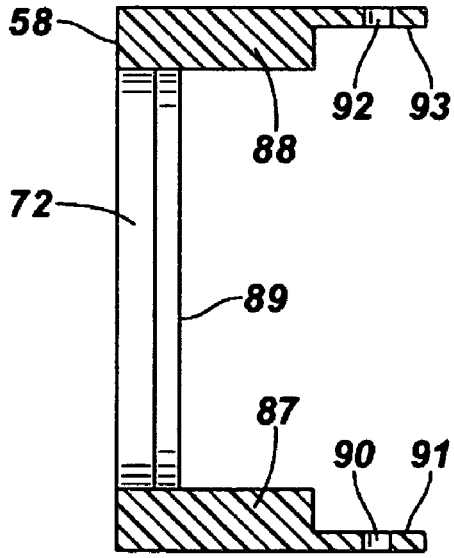
Figure 6A:
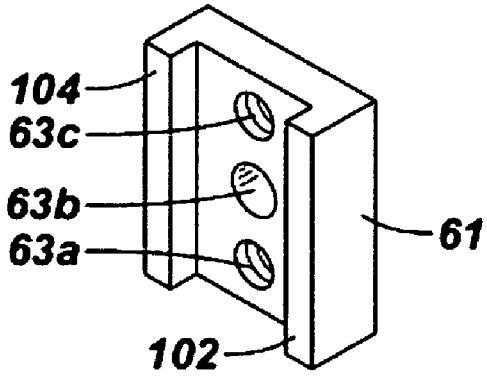
FIGS. 6A, 6B, 6C, and 6D are schematic perspective, top plan, front elevation, and side elevation (some parts in phantom) views, respectively, of the horizontal adjustment block illustrated in the bow sight embodiment of FIG. 2.
Figure 6B:
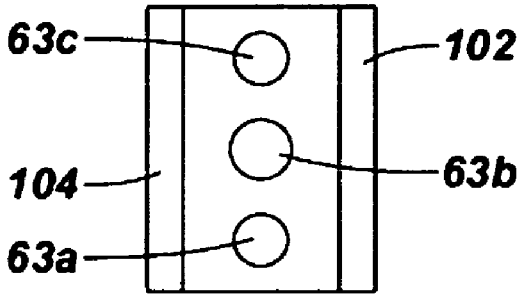
Figure 6C:
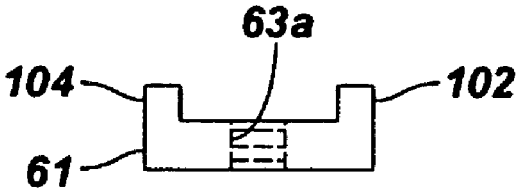
Figure 6D:
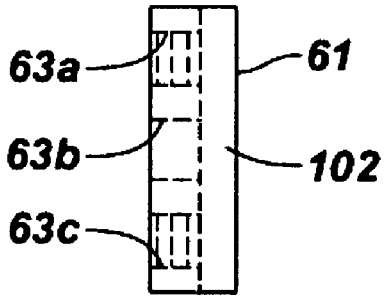
Figure 7A:
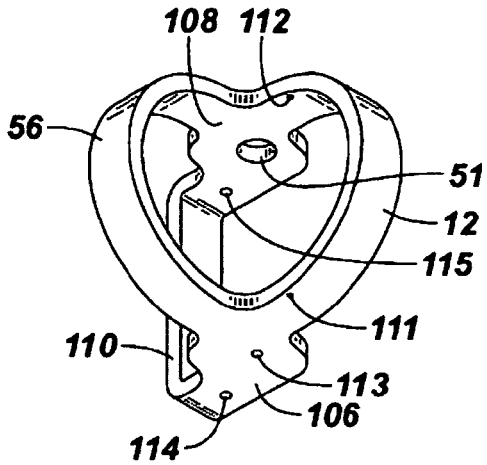
FIGS. 7A, 7B, 7C, 7D, and 7E are schematic perspective, front elevation, side elevation, bottom plan, and top plan views, respectively, of the sight pin guard illustrated in the bow sight embodiment of FIG. 2.
Figure 7B:
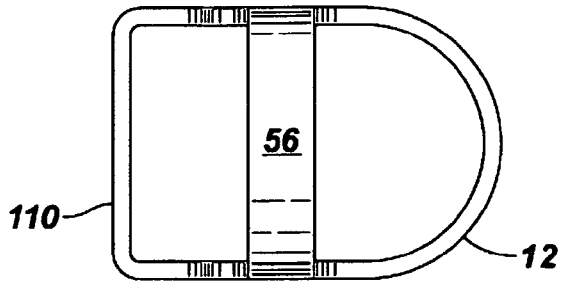
Figure 7C:
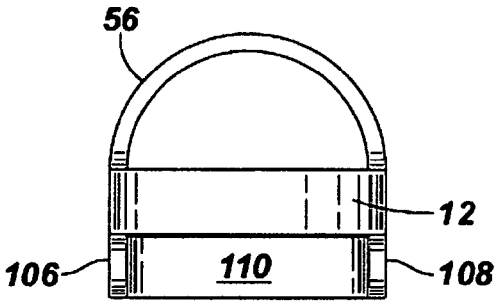
Figure 7D:
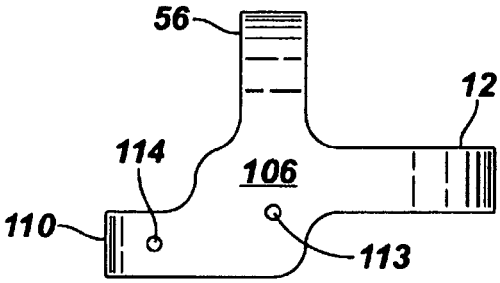
Figure 7E:
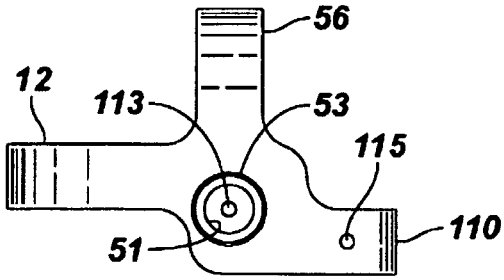

FIGS. 5A, 5B, and 5C are schematic perspective, front elevation, and cross sectional views, respectively, of vertical adjustment block 58 illustrated in the bow sight embodiment of FIG. 2. Extensions 87 and 88 and in tips 93 and 91, respectively, the tips having through holes 92 and 90, respectively for accepting screws 74 and 78 (FIG. 3). A main body portion 89 connects extensions 87 and 88. FIG. 5C is a cross section along line A-A of FIG. 5B. Vertical adjustment blocks, if used, may comprise metal, plastic, or composite materials.

FIGS. 6A, 6B, 6C, and 6D are schematic perspective, top plan, front elevation, and side elevation (some parts in phantom) views, respectively, of the horizontal adjustment block illustrated in the bow sight embodiment 50 of FIG. 2. Through hole 63*b* is not threaded and may be slightly larger than threaded holes 63*a* and 63*c*. Hole 63*b* allows screw 66 to pass though and mate with nut 65, while holes 63*a* and 63*c* are threaded to mate with screws 68 and 70, respectively. Rails 102 and 104 mate in sliding engagement with main body portion 89 of vertical adjustment block 58. Horizontal adjustment blocks, if used, also may comprise metal, plastic, or composite materials.

FIGS. 7A, 7B, 7C, 7D, and 7E are schematic perspective, front elevation, side elevation, bottom plan, and top plan views, respectively, of the sight pin guard illustrated in the bow sight embodiment 50 of FIG. 2. In addition to features already discussed, the sight pin guard may comprise two very small diameter holes 111 and 112 for securing a sighting wire (not shown), as well as a hole 113 in a lower shaft support region 106 for passing through threaded stud 81 for mating with lock nut 83 (FIG. 4), located at the bottom of rotatable shaft 52 therein. Sight pin guards of the invention also include an upper shaft support region 108. Through holes 114 and 115 accept screws 78 and 74, respectively (FIG. 3) for securing the sight pin guard 12, 56 to vertical adjustment block 58. Each of the side portion 12 and forward portion 56 of the sight pin guard comprise respective upper and lower ends, the upper ends terminating in the upper shaft support region 108, and the lower ends terminating in the lower shaft support region 106. The upper shaft support region 108 has a first through-hole 51 accepting and holding the rotatable shaft 52 (FIG. 2); the lower shaft support region 106 has a second through-hole 113 which accepts and holds stud 81.

Figure 8A:
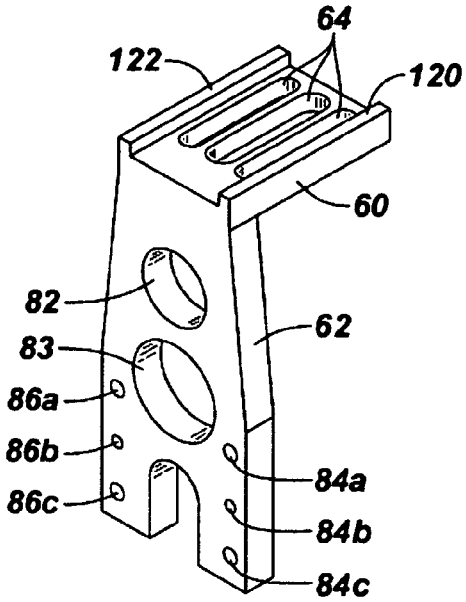
FIGS. 8A, 8B, 8C, 8D, and 8E are schematic front perspective, rear perspective, side elevation, rear side elevation, and top plan views, respectively, of the bow sight platform illustrated in the bow sight embodiment of FIG. 2.
Figure 8B:
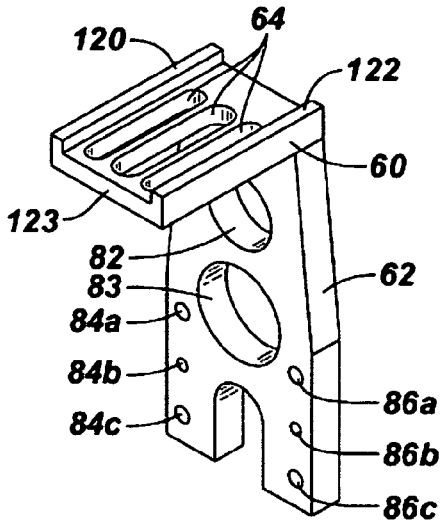
Figure 8C:
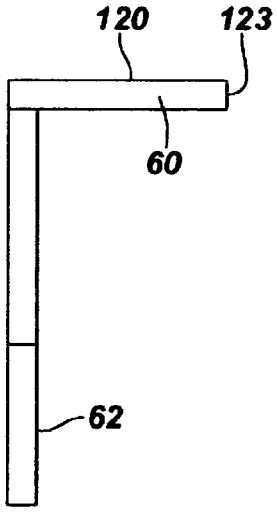
Figure 8D:
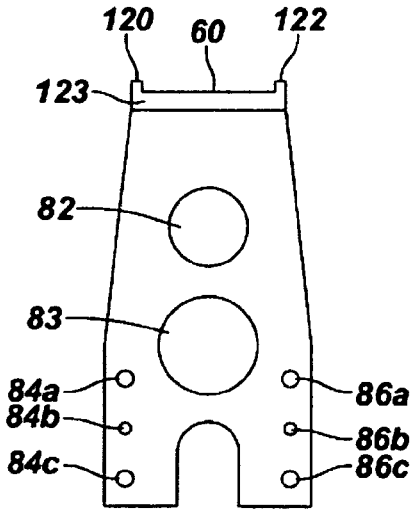
Figure 8E:
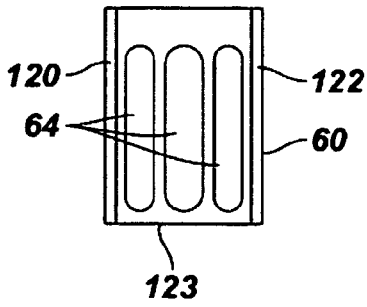

FIGS. 8A, 8B, 8C, 8D, and 8E are schematic front perspective, rear perspective, side elevation, rear side elevation, and top plan views, respectively, of the bow sight platform illustrated the bow sight embodiment 50 of FIG. 2. The rear perspective view of FIG. 8B and rear side elevation view of FIG. 8*d* reveal four through holes 84*a*, 84*c*, 86*a*, and 86*c* that may have beveled lips suitable for acceptance of flat heads screws (not shown) for attaching the bow sight to a bow, and holes 84*b* and 86*b* for attaching a bow quiver. FIGS. 8A and 8E illustrate gang adjustment slots 64 in block 60. The size of edges 120, 122, and 123 may be adjusted as desired during manufacture.

Figure 9A:
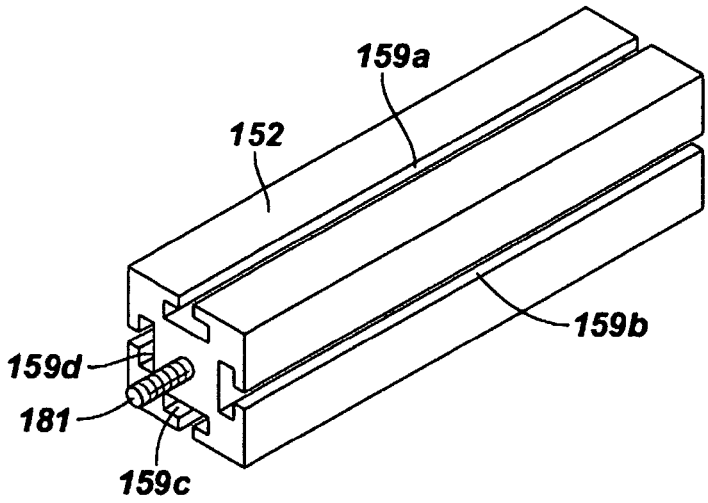
FIGS. 9A and 9B are perspective and bottom plan views, respectively, of an alternative rotatably shaft useful in bow sights of the invention.
Figure 9B:
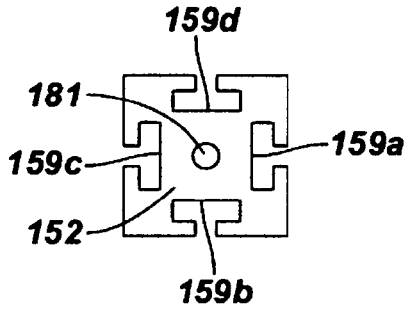

FIGS. 9A and 9B are perspective and bottom plan views, respectively, of an alternative rotatable shaft useful in bow sights of the invention. In this embodiment, one or more rectangular slots 159*a*, 159*b*, 159*c*, and 159*d* are machined, cut, or molded into rotatable shaft 152. Rectangular slots 159 accommodate mating pieces of flat stock material. The sight pins (not illustrated) are attached to a correspondingly sized piece of flat stock, and again the vertical adjustment would be made by tightening or loosening set screws in the flat material and moving the sight pin or pins up or down on the rotatable shaft. A stud 181 and locknut (not shown) may be used to secure rotatable shaft 152 to a sight pin guard (not illustrated).

Figure 10:
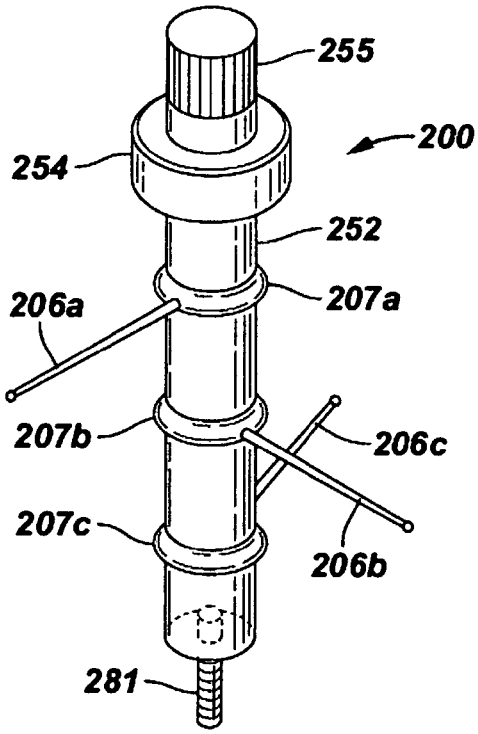
FIG. 10 is a perspective view of an alternative rotatable shaft embodiment within the invention.

FIG. 10 illustrates a perspective view of an alternative rotatable shaft and sight pin arrangement 200 within the invention. Alternative embodiment 200 requires no machining, cutting, or molding of slots or grooves into rotatable shaft 252. Rather, sight pins 206*a*, 206*b*, and 206*c* are attached to shaft 252 using rubber O-rings 207*a*, 207*b*, and 207*c*, respectively. A stud 281 and locknut (not shown) is provided as in other embodiments. Knob 254 and knurling 255 may be substantially the same as in embodiment 50.

Figure 11:
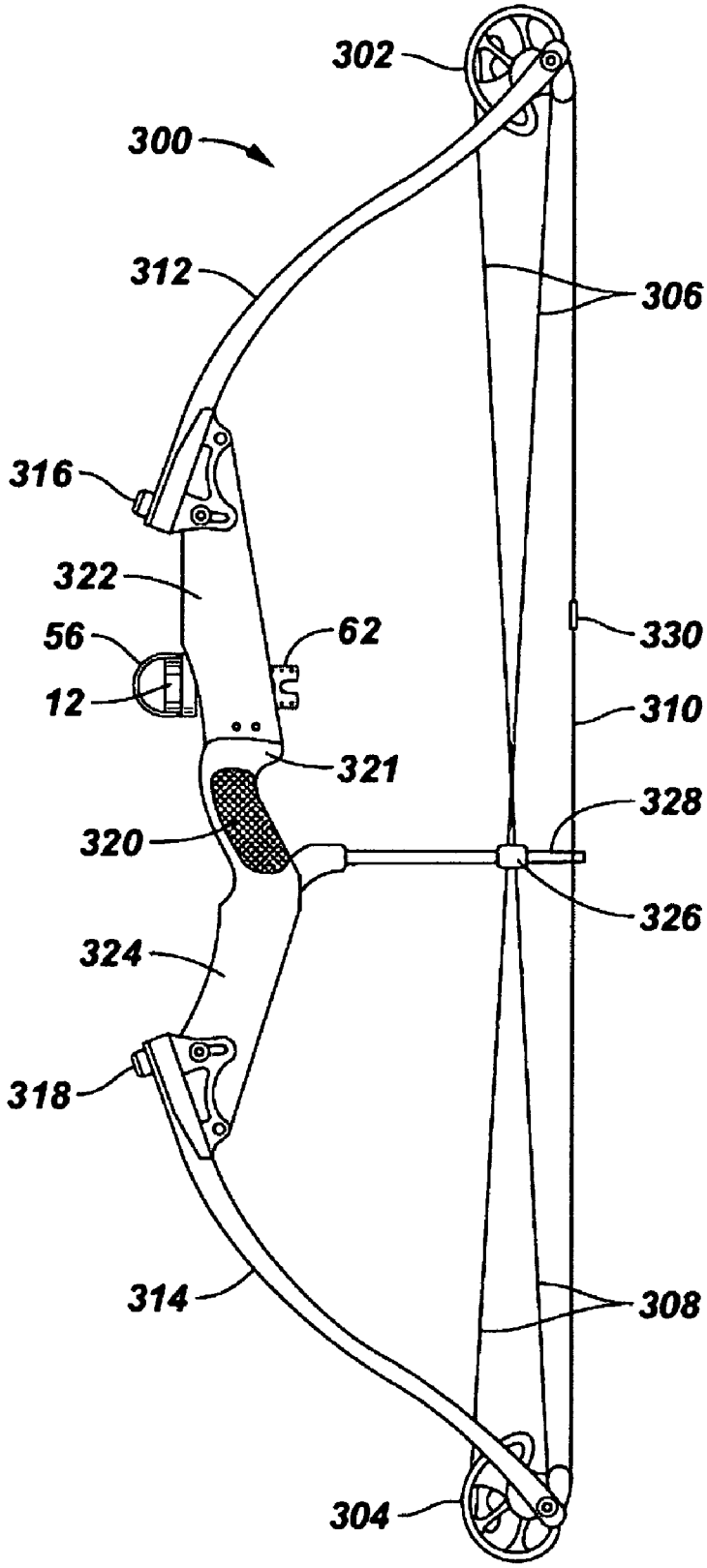
FIG. 11 is a side elevation view of a compound archery bow in accordance with the invention.

Another aspect of the invention are archery bows incorporating a bow sight of the invention, such as the bow embodiment 300 illustrated schematically in FIG. 11, which comprises conventional components such as eccentrics 302 and 304, aim cables 306 and 308, bow string 310, and bow limbs 312 and 314. Archery bows of this nature also typically include dual line adjustment bolts 316 and 318, a stabilizer bushing 324, a grip 320, a riser 321, and a sight window 322. Sight pins guards 12 and 56 of a bow sight of the invention are illustrated, as well as mounting platform 62, which is secured to sight window 322 using flat head screws or other attachment means, not illustrated in FIG. 11. A cable guard glide 326 and cable guard bar 328, as well as a peep sight 330 complete this embodiment. Those skilled in the art of archery will recognize many variations of components that may still be within the scope of the present invention.

Archery bows are made by a variety of manufacturers, and a non-exclusive list of suppliers and their presently known trade designation products might include compound bows known under the trade designations "Fatal Impact" and "Micro Stalker", available from Alpine Archery, Lewiston, Id.; "Mirage ZX", "F5 Tornado", "Adrenaline X", and Rage One", available from Browning Archery, Tucson, Ariz.; "Magnum Extreme" and "Maverick Extreme", from Darton; "Obsession", "Mossy Oak", and "Buckmasters", available from Fred Bear Outdoors, Escalade Sports, Evansville, Ind.; "Vengeance", available from Precision Shooting Equipment, Inc., Tucson, Ariz.; and "Switchback XT", available from Mathews of Sparta, Wis.

Parameters commonly used to describe compound bows include axle-to-axle length, limb or split limb length, brace height, draw length range, and mass weight. Compound bows in accordance with the invention include those having an axle-to-axle length ranging from about 25 to about 40 inches, a limb or split limb length ranging from about 10 to about 20 inches, a brace height ranging from about 5 to abut 10 inches, a draw length range ranging from about 20 to about 35 inches, and a mass weight ranging from about 2.5 to about 5.0 lbs. As a bow's string is drawn it's eccentrics turn, wrapping up cable and pulling the limb tips toward each other. Energy is stored in the flexing limbs, cables, and cams. The velocity that an arrow will fly when released by the string, and the kinetic energy, or "punching power" that the arrow will carry when impacting game, depends largely on the amount of energy stored in the bow as it is drawn. Three parameters largely determine the arrow velocity: the bow's maximum draw weight, the distance the string is drawn, and the shape of the eccentrics on the bow. Lever arms within the eccentrics create what is termed the bow's let-off. The Archery Manufacturer's Organization (AMO) is an industry standards committee that has put forth a method for measuring arrow speed. AMO speed is found by shooting a 540-grain arrow from a 60-pound bow with a 30-inch draw length, and the "AMO speed" for any bow on the market may be requested. The International Bowhunter's Organization also promotes an arrow speed standard that is becoming more accepted than the AMO standard. The IBO speed is found by shooting a 350-grain arrow from a 70-pound bow with a 30-inch draw length. A good bow should have AMO speeds in the range of 215 fps (290 fps IBO) to 235 fps range (315 fps IBO).

A bow's brace height may affect both speed and accuracy. Brace height is defined as the distance from string 310 to the back of grip 320 when the bow is in its undrawn state. At brace heights over about 7 inches the bow may become more forgiving and more accurate. As the brace heights becomes shorter than 7 inches the bow may become more critical and harder to shoot well with less than perfect shooting form. Short brace lengths may multiply any shooting form flaws.

When referring to materials of construction of the various components, metals may be selected from steels, including various stainless steels, titanium, beryllium, metal matrix composites, and in certain cases, depending on the component, aluminum, copper, nickel, chrome, brass, aluminum, and the like. For components expected to undergo a lot of stress, such as the vertical and horizontal adjustment blocks, steel and titanium may be better choices than aluminum and copper, for example. Suitable plastic materials include high-strength polymeric materials such as thermoplastic elastomers and high-density versions of polyethylene, polypropylene, polyacrylate, polymethyl methacrylate, polycarbonate, polyamide, polyurea, polyurethane, and the like. Apparatus of the invention may include adhesives, camouflaged tape, and a variety of color schemes, especially those conducive to hunting game. The polymeric materials, if used, may be strengthened by additives, such as fibers, nanoparticles, nanotubes, nanoplatelets, and the like. The additives may be carbon-based or non-carbon based, such as nanoclays and glass fibers.

Sight pins useful in apparatus and bows of the invention include non-fiber optic and fiber-optic sight pins. Sight pins typically are comprised of a square pin base (sometimes referred to herein as an "anchor") with a metallic pin body, such as beryllium. A bead is center drilled and typically holds a strand of optical fiber having a diameter ranging from about 0.020 inch to about 0.040 inch. The pin body length may range from 0.5 inch up to 1.5 inches. Typically the pins have a black matte finish to reduce glare. In some pins the fiber optic is wrapped around the pin body. Up to several feet of optical fiber may be wrapped around a single pin body. Batteries may be used to operate lights if lights are included in the design. Batteries such as 1.5 volt batteries, similar to watch batteries, may be used. While the bow sights of the invention may use lights and batteries, they are not required since the fiber optic pins are designed to gather sunlight during normal use.

In conclusion, apparatus of the invention solve many of the problems that exist with the current bow-sights of today, and it does this in a unique way that may benefit anyone who aims a bow and arrow at a target. Although only a few exemplary embodiments of this invention have been described in detail above, those skilled in the art may readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. §112, paragraph 6 unless "means for" is explicitly recited together with an associated function. "Means for" clauses are intended to cover the structures described herein as performing the recited function and not only structural equivalents, but also equivalent structures.

What is claimed is:

1. An apparatus comprising:

a) a sight pin guard comprising a side portion and a forward portion, each of the side and forward portions comprising respective upper and lower ends, the upper ends terminating in an upper shaft support region, and the lower ends terminating in a lower shaft support region, the upper shaft support region having a first through-hole accepting and holding a rotatable shaft, the lower shaft support region having a second through-hole accepting and holding a stud affixed to a lower end of the rotatable shaft, the side portion of the sight pin guard defining a sighting plane; and b) the rotatable shaft having operatively connected thereto a knob positioned external of the sight pin guard, the knob allowing rotation and indexing of the shaft without reaching into the sight pin guard; and c) a plurality of sight pins, each sight pin having a connector end and a sight end, the connector ends removably and adjustably installed at different longitudinal and circumferential locations on the rotatable shaft so that upon rotation of the shaft a different one of the sight ends is viewable in the sighting plane.

2. The apparatus of claim 1 wherein the rotatable shaft comprises one or more machined, cut, or molded slots into which the connector ends of the sight pins fit.

3. The apparatus of claim 1 wherein the connector ends of the sight pins comprise O-rings slideably engaged with an outside surface of the rotatable shaft.

4. The apparatus of claim 1 wherein the forward portion of the sight pin guard extends in a plane generally parallel to a plane of a bow.

5. The apparatus of claim 1 comprising horizontal and vertical adjustment blocks.

6. The apparatus of claim 1 wherein upon indexing, two sight ends of two sight pins are viewable in the sighting plane.

7. An archery bow comprising:

a) a bow frame;

b) a sight pin guard attached to the bow frame, the sight pin guard comprising a side portion and a forward portion, each of the side and forward portions comprising respective upper and lower ends, the upper ends terminating in an upper shaft support region, and the lower ends terminating in a lower shaft support region, the upper shaft support region having a first through-hole accepting and holding a rotatable shaft, the lower shaft support region having a second through-hole accepting and holding a stud affixed to a lower end of the rotatable shaft, the side portion of the sight pin guard defining a sighting plane;

c) the rotatable shaft having operatively connected thereto a knob positioned external of the sight pin guard, the knob allowing rotation and indexing of the shaft without reaching into the sight pin guard; and d) at least one sight pin installed in the rotatable shaft, the sight pin having a connector end and a sight end, the connector end removably and adjustably installed at different longitudinal and circumferential locations on the rotatable shaft so that upon rotation of the shaft a different one of the sight ends is viewable in the sighting plane.

* * * * *